United States Patent [19]

Bardin et al.

[11] Patent Number: 5,065,825

[45] Date of Patent: Nov. 19, 1991

[54] METHOD AND DEVICE FOR REMOTE-CONTROLLING DRILL STRING EQUIPMENT BY A SEQUENCE OF INFORMATION

[75] Inventors: Christian Bardin; Guy Pignard, both of Rueil Malmaison; Jean Boulet, Paris; Pierre Morin, Levallois Perret, all of France

[73] Assignee: Institut Francais du Petrole, Rueil Malmaison, France

[21] Appl. No.: 459,282

[22] Filed: Dec. 29, 1989

[30] Foreign Application Priority Data

Dec. 30, 1988 [FR] France ..... 88 17604

[51] Int. Cl.[5] ..... E21B 47/12

[52] U.S. Cl. ..... 175/38; 175/40; 175/48; 367/83

[58] Field of Search ..... 175/40, 48, 24, 25, 175/26, 27, 38, 61; 166/53, 250; 367/83, 84, 85; 340/861

[56] References Cited

U.S. PATENT DOCUMENTS

| | | | |
|---|---|---|---|
| 4,100,528 | 7/1978 | Bernard et al. | 367/83 |
| 4,354,233 | 10/1982 | Zhukovsky et al. | 175/27 |
| 4,454,598 | 6/1984 | Claycomb | 175/40 |
| 4,655,299 | 4/1987 | Schoeffler | 175/48 |
| 4,698,794 | 10/1987 | Kruger et al. | 367/83 |
| 4,734,893 | 3/1988 | Claycomb | 175/40 |
| 4,854,397 | 8/1989 | Warren et al. | 175/26 |

*Primary Examiner*—Terry L. Melius

*Attorney, Agent, or Firm*—Antonelli, Terry, Stout & Kraus

[57] ABSTRACT

A method of and a device for remotely-controlling at least one piece of drill string equipment from an instruction issued from the surface. The method includes issuing from the surface a first information sequence to cause a first predetermined action according to a predetermined sequence, detection of a condition indicative of a second sequence resulting from the first sequence, comparison of this second sequence with another predetermined sequence, and operating the equipment only if there is similarity between the latter two sequences. The method can be applied to actuation of a variable-angle bent element.

12 Claims, 4 Drawing Sheets

METHOD AND DEVICE FOR REMOTE-CONTROLLING DRILL STRING EQUIPMENT BY A SEQUENCE OF INFORMATION

BACKGROUND OF THE INVENTION

The present invention relates to a method and a device for remote control of drill string equipment.

In general, such equipment is controlled by an electric cable. However, the use of a cable represents a considerable hindrance for the driller because of the very presence of the cable either inside the drill string or in the annular gap between the drill string and the well walls.

It has been proposed that such control be effected by detecting a flowrate threshold or activation flowrate of an incompressible fluid, as described in Patent FR-2,575,793. Such systems may inadvertently trigger the element to be controlled due to the instability of flows in the drill string.

SUMMARY OF THE INVENTION

The present invention avoids these drawbacks and avoids inadvertent triggering since, according to the present invention, a predetermined sequence of events relation to one or more magnitudes detectable at the bottom of the well (which sequence may also be termed "information sequence") is required before the desired action is triggered.

Such magnitudes may be values linked to the fluid flowing in the drill string or to the mechanical link which the drill string itself constitutes.

The flowrate of fluids circulating in the drill string, the weight on the tool, and/or the rotational speed of the tool could be used.

More generally, the present invention relates to a method of remotely controlling at least one piece of drill string equipment from an instruction issued from the surface, characterized by comprising the following stages:

- issuing from the surface a first information sequence, to cause a first action, according to a predetermined sequence,
- detection of a second sequence resulting from a condition indicative of the first action, and comparison of this second sequence with another predetermined sequence,
- operating the equipment only if there is similarity between the latter two sequences.

It is established that this other sequence differs from the predetermined sequence issued at the surface only by containing any conversions due to the transmission.

The sequences may relate to variations as a function of time in at least one of the following magnitudes: flowrate of drilling fluid, rotational speed of at least part of the drill string, or weight on the tool.

The sequences may also combine two or more of the above magnitudes.

The sequences may concern the flowrate of drilling fluid and may include the flowrate rising from a first flowrate level to a second flowrate level within a given time interval.

The variations in the magnitude or magnitudes may occur in a given minimum time interval and/or a given maximum time interval. Thus, it is possible according to the present invention to define time windows.

The present invention also relates to a device for remote control of at least one piece of drill string equipment from information transmitted from the surface.

This device comprises information transmitting means and means for detecting said information, the latter being connected to means for actuating said equipment.

The transmitting means may be drilling fluid pumps, the detection means may include a flowmeter and a flow measurement processing module and actuating means that may include at least one solenoid valve.

The solenoid valve may, when energized, place a pressurized oil reservoir in communication with a chamber whose changes in volume causes actuation of the equipment.

The device according to the invention may include a check valve allowing discharge of the oil contained in the chamber into the reservoir when the oil pressure in the oil reservoir is less than the pressure prevailing in the chamber.

The equipment may be a variable-angle bent element.

The equipment may be a variable-geometry stabilizer.

BRIEF DESCRIPTION OF THE DRAWINGS

The present invention will be better understood and its advantages will emerge more clearly from the description which follows specific examples, which are not limitative, illustrated by the attached figures wherein.

DETAILED DESCRIPTION OF A PREFERRED EMBODIMENT

Figure 1:
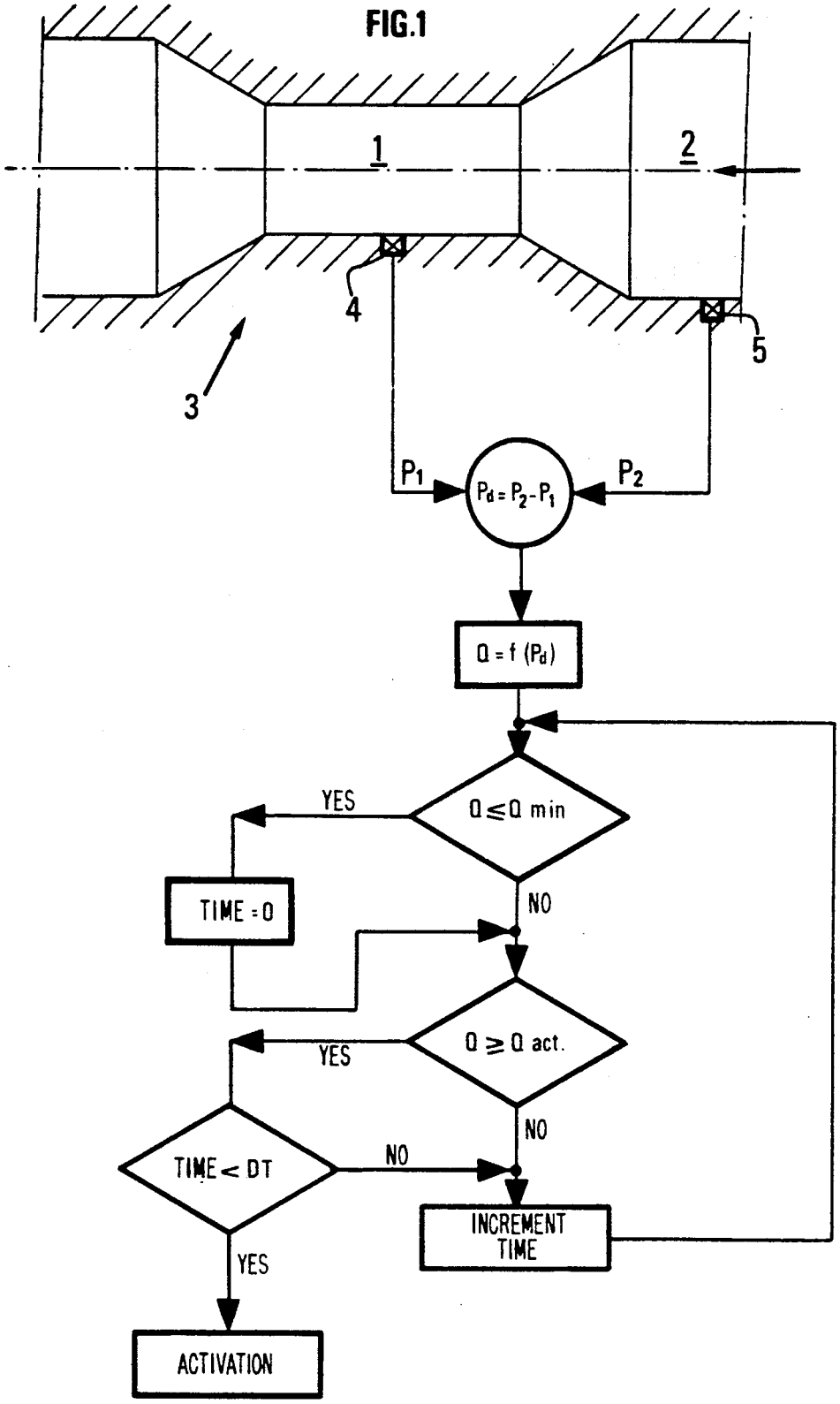
FIG. 1 represents a logic diagram corresponding to a sequence of information relating to one magnitude linked to flow, in this case the pressure differential between the pressure at a point upstream of a venturi and the pressure at the throat of this venturi.
Figure 2:
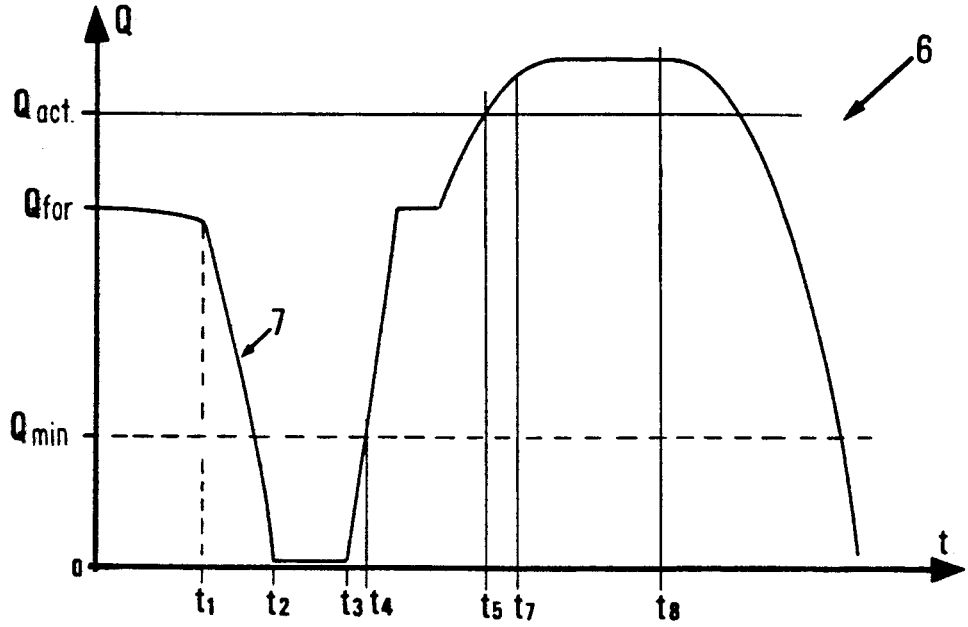
FIG. 2 illustrates one example of the variation of the pressure differential as a function of time in the case of the sequence in FIG. 1, FIGS. 3A and 3B show a device allowing the method according to the invention to be implemented.

FIGS. 1 and 2 relate to a simple example of a sequence based on a fluid flowrate. According to this example, actuation occurs if the flowrate of the fluid circulating in the drill string changes from one level to another within a given time interval.

The flowrate is measured by measuring the differential pressure Pd between throat 1, where the pressure is designated $P_1$, and the upstream part 2, where the pressure is designated $P_2$, of a venturi 3, which has the advantage of simple geometry creating little pressure loss and which avoids the use of moving parts.

$$P_d = P_2 - P_1$$

The pressure differential between upstream part 2 and throat 1 of venturi 3 is measured by two piezo-resistive sensors 4 and 5 whose gauge bridges are connected in a differential arrangement.

The pressure range the sensors can withstand may be 0 to 750 bars.

Their differential measurement range may be 0 to 40 bars.

The measurement accuracy may be on the order of 1%.

The device according to the invention may include an electronic assembly having the functions, in the case of the example of FIG. 1, of:

supplying sensors 4 and 5 and carrying out the measurement;

detecting a flow sequence starting with zero flow, considered Qmin, which then rises above a threshold value Qact, adjustable at the surface before the drilling equipment is lowered into the well. The magnitude must exceed the threshold value Qact within a given time interval DT which follows the re-starting of the flow; this time interval DT may be 5 to 10 minutes. Once this time DT has passed, if the sequence has not been completed in the specified manner, the electronics may be placed on standby until the next flow cutoff. Any actuation command is then impossible;

setting the flow threshold value, which may be done on the basis of 16 positions where the increment between the positions is 100 liters per minute for water.

FIG. 2 shows a curve where the flow Q changes as a function of time t.

This curve 6 corresponds to a flowrate sequence which in fact gives rise to actuation of the element to be controlled.

The dashed horizontal line corresponds to the flowrate Qmin, and the upper horizontal line corresponds to the flowrate activation or actuation threshold Qact.

On this diagram, Qfor corresponds to the normal flowrate during drilling.

The decision to control the device to be actuated is made at time $t_1$.

The pumps are then stopped at the surface so that the flowrate detected by the electronic assembly becomes less than Qmin.

The portion 7 of the curve corresponds to the drop in flowrate down nearly to zero, in any event less than Qmin. This level is reached at time $t_2$.

At time $t_3$, the pumps are started again, and at $t_4$ threshold Qmin is crossed.

After this time, the electronic system measures the time required to establish whether the time elapsed between time $t_4$ and time $t_5$, when the flowrate has reached flow Qact, is less than a predetermined time DT.

In the case of FIG. 2, it has been assumed that the answer is "yes". After a delay $r=t_5-t_7$, the element to be controlled is actuated until time $t_8$. After this time, it is possible to stop the pumps.

The lower part of FIG. 1 shows a logic diagram corresponding to the description of FIG. 2.

Flow Q passing at a given point in time through venturi 3 is determined from pressures $P_1$ and $P_2$, by subtracting one of these two pressures from the other.

Then, a first test is made on flow Q by comparing it to a flow Qmin. Flow Qmin is small and may be close to zero.

In the case where flow Q is less than or equal to Qmin, the clock is initialized at zero; if not, the clock is not changed.

Then a second test is done, comparing flow Q to an actuation flow Qact. If flow Q is less than flow Qact, the first test is repeated, but at the new flow value, and the clock time is incremented.

If at the second test, flow Q is higher than flow Qact, a third test is run on the time shown by the clock.

The value of this display corresponds to the time taken for the flow to increase from the value Qmin to the value Qact.

The third test compares this display to a maximum time interval DT.

If the time displayed by the clock is less than DT, this means that the flow sequence is a valid control sequence, and actuation takes place, for example by opening a solenoid valve.

If it is not, the system should be set to standby detection until the flow detected returns to Qmin or less than Qmin.

This may be accomplished as shown in FIG. 1, i.e. by returning to the start of the first test and allowing the clock time to increase.

Thus, it appears clearly that, if during the drilling phase (which has already lasted at least a time DT) with a liquid flowrate Qfor, there was an accidental increase in the drilling flowrate before the start of actuation, the actuation itself would not be effected, because the time taken to go from Qmin to Qact would be greater than DT.

Figure 3A:
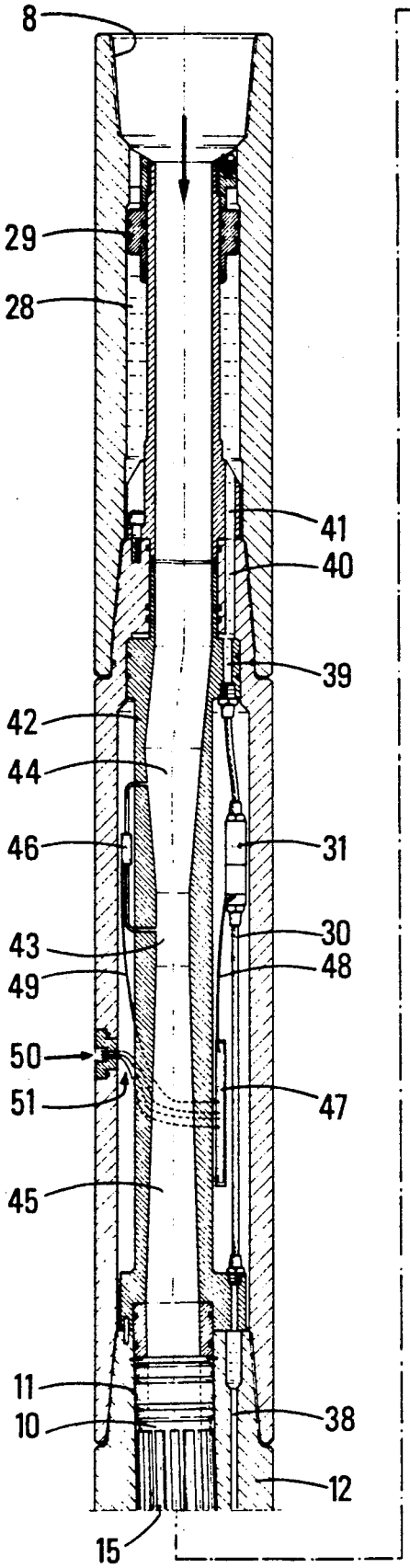
Figure 3B:
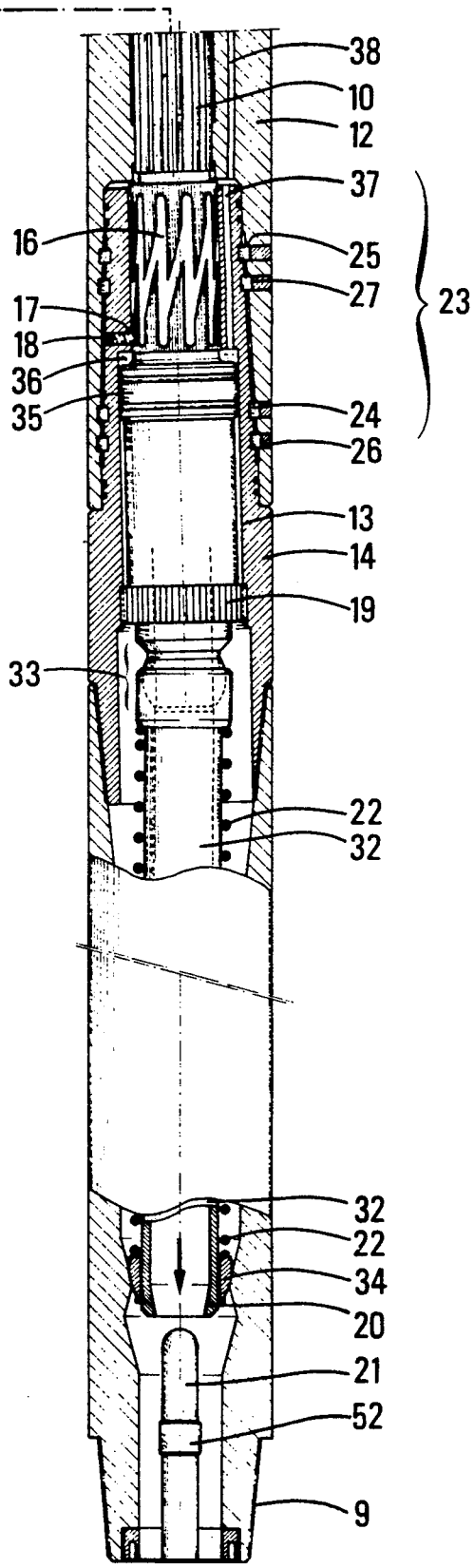

FIGS. 3A and 3B represent one embodiment of the device according to the present invention applied to actuation of a variable-angle bent element.

According to this embodiment, a tubular-shaped element has at its upper part an internal thread 8 for mechanical linkage with a drill string or a packer and in its lower part an external thread 9 allowing the attachment of the remainder of the drill string or the packer.

The bent element comprises a shaft 10 whose upper part can slide in bore 11 of body 12 and whose lower part can slide in bore 13 of body 14. This shaft has male corrugations 15 that mesh with female corrugations of body 12, grooves 16 which are alternately straight (parallel to the axis of tubular body 12) and oblique (inclined to the axis of tubular body 12), in which fingers 17, which slide along an axis perpendicular to that in which shaft 10 moves, engage, and are held in contact with the shaft by springs 18, male corrugations 19 engaging the female corrugations of body 14 only when shaft 10 is in the upper position.

Shaft 10 is equipped with a bean 20 at the bottom, opposite which is a needle 21 coaxial to the displacement of shaft 10. A return spring 22 holds shaft 10 in the upper position, with corrugations 19 engaging corresponding female corrugations in body 14. Bodies 12 and 14 are rotationally free at rotating zone 23, which is inclined with respect to the axes of bodies 12 and 14 and is composed of rows of cylindrical rollers 24 inserted in their races 25 and extractable through orifices 26 by removing door 27.

An oil reservoir 28 is kept at the pressure of the drilling fluid by a free annular piston 29. The oil lubricates the sliding surfaces of shaft 10 through passage 30. This passage may include a solenoid valve 31.

Bean 20 is supported by a tube 32 which is attached to shaft 10 by means of a coupling 33. This coupling 33, as well as coupling 34, allow tube 32 to bend when shaft 10 moves. This bending remains small, since the maximum angle assumed by the bent elements is generally a few degrees.

Shaft 10 has a second piston 35. This piston 35 defines, with tubular body 13, a chamber 36. Piston 35 slides in bore 13 provided in tubular body 14. Chamber 36 communicates via holes 37, 38 with passage 30 that includes solenoid valve 31, and hence with oil reservoir 28 through holes 39, 40, and 41.

Oil reservoir 28 and chamber 36 communicate through solenoid valve 31 when there is a valid control sequence, i.e. one that actually corresponds to actuation of the equipment to be controlled.

Venturi 42 has a throat 43, an upstream zone 44, and a downstream zone 45, a pressure sensor 46, which may be differential, or two pressure sensors 4 and 5 as shown in FIG. 1.

This sensor or these sensors are connected by electric wires 49 to an electronic module 47 which monitors the flowrates to detect the control sequence and to trigger actuation. For this purpose, electronic module 47 is connected by electric wires 48 to solenoid valve or electrodistributor 31.

An external connector 50 allows communication between the surface and electronic module 47 without disassembling the entire device. Connector 50 is connected to module 47 by electric wires 51. This also makes it possible to program electronic module 47 or to dump its memory without undoing the connection.

When a flowrate sequence is detected, the electronic module sends, possibly after a time adjustable in the shop between 0 and 60 seconds, a control signal to open electrodistributor 31. This control signal may be continued until the next time the flow stops or the flow drops below the value Qmin.

The electronic module may also store in its memory the times at which a control signal was transmitted.

The electronic module may be powered by a set of rechargeable or nonrechargeable batteries. The supply voltage may be 24 volts; the power necessary for an electrodistributor to function is 15 watts.

When solenoid valve 31 opens, oil reservoir 28 communicates with chamber 36.

The flowrate of the fluid passing through the device creates a pressure loss which causes a force that tends to act on piston 29 to expel the oil from reservoir 28 to chamber 36.

As long as solenoid valve 31 is closed, this is not possible and the equipment is thus not activated.

As soon as solenoid valve 31 has opened, shaft 10 moves downward and actuates the variable-angle bent element. The lowering of shaft 10 occurs outright because of the bean 20—needle 21 system which, as soon as they cooperate with each other, bring about an increase in the pressure loss and thus increase the forces tending to lower shaft 20.

Needle 21 has a cuff 52 so that, when bean 20 arrives, there is a variation in the pressure loss which, at a constant flowrate, results in a variation in pressure detectable at the surface, which informs the operators that shaft 10 has reached its bottom position.

Shaft 10 is raised by lowering or eliminating the flowrate, so that the forces exerted on pistons 29 and 35 are sufficiently weak for spring 22 to be able to return shaft 10 to its top position.

In order to limit the energization time of solenoid valve 31 and hence save on electrical energy, solenoid valve 31 may include a check valve allowing oil to flow to the oil reservoir when there is a pressure gradient in this direction and blocking the flow when the gradient is in the other direction.

Figure 6:
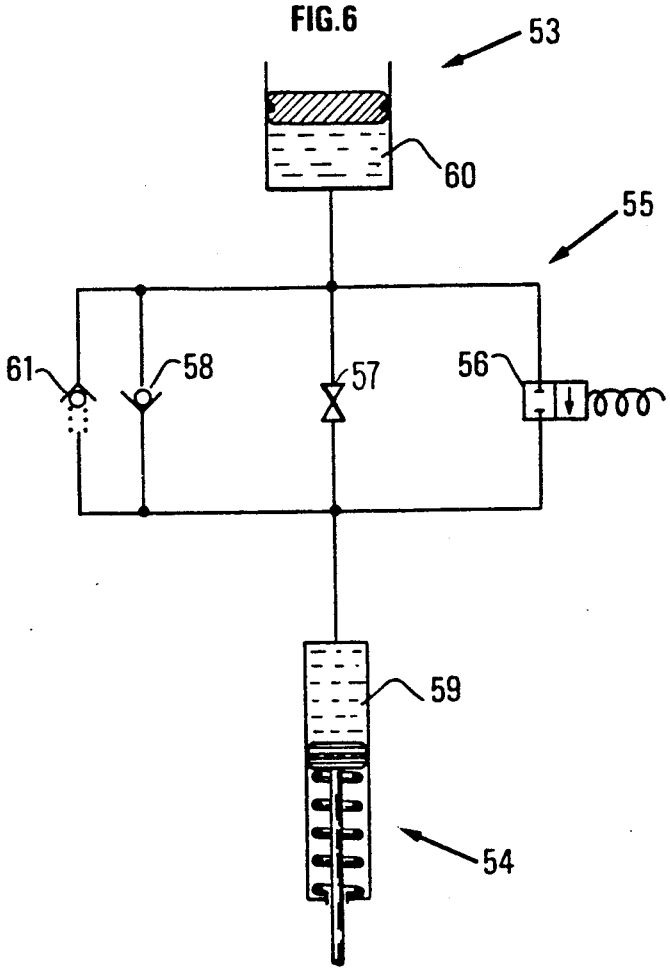

FIG. 6 illustrates such an arrangement schematically.

Reference 53 designates the oil reservoir and its piston. These references correspond to references 29 and 28 of FIG. 3A.

Reference 54 designates the pressurized fluid reception chamber and the working piston, which correspond essentially to references 16 and 35 of FIG. 3B.

Reference 55 designates a solenoid valve equipped with accessories.

Reference 56 designates the solenoid valve itself.

Reference 57 designates a manual safety valve, reference 58 a check valve which allows chamber 59 to be emptied when the pressure in reservoir 60 is less than that in chamber 59.

Reference 61 designates a calibrated check valve allowing reservoir 60 to empty into chamber 59 is the pressure differential between these two zones is greater than a critical value which may be 40 to 60 bars.

Of course, it will not be a departure from the scope of the present invention to apply the device according to the present invention to equipment other than a variable-angle bent element. Thus, the present invention may be applied to actuation of a variable-geometry stabilizer such as that described in Patent FR-2,579,662. In this case, shaft 10 will be coaxial with tubular bodies 12 and 14 and it will be unnecessary to use cuff 33.

It will not be a departure from the scope of the present invention to use other types of sequences which may or may not combine several parameters.

Examples of combinations of parameters are given below:

- fluid flowrate higher than a given threshold, and weight on tool less than a given threshold, or alternatively higher than a given threshold,
- fluid flowrate higher than a given threshold, and rotational speed of packer within a given range,
- the control sequence may be based only on variations in weight exerted on the drilling tool,
- the control sequence may be based on variations in the weight exerted on the drilling tool, provided the drilling fluid flowrate is less than a given flowrate which may be relatively low or zero.

The present invention allows two different pieces of equipment to be operated by two different sequences.

Figure 5:
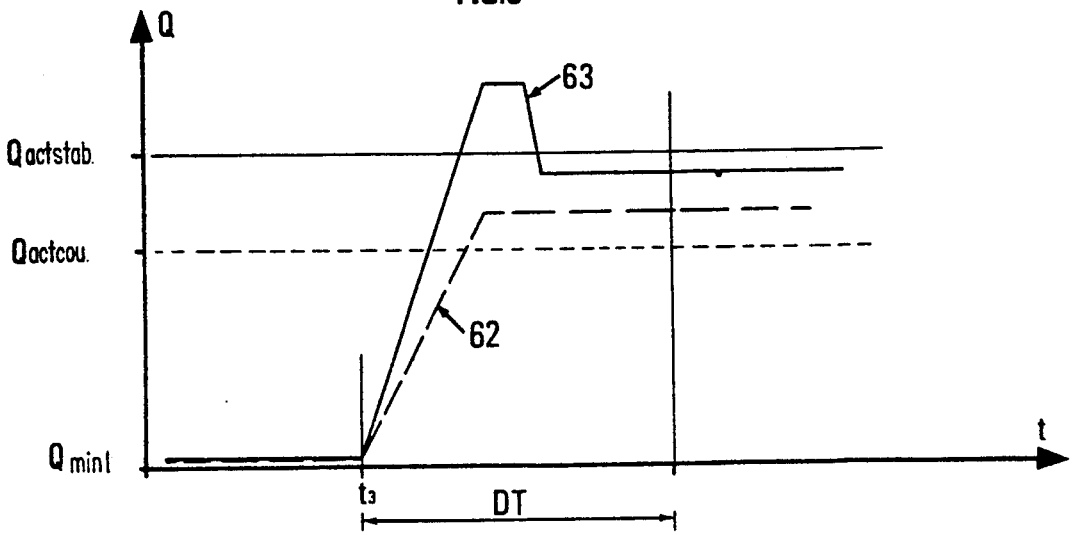

FIG. 5 shows two curves 62 and 63 corresponding to two different flowrate sequences.

First curve 62 corresponds, for example, to triggering of actuation of a variable-angle bent element, and the second curve 63 corresponds to actuation of a variable-geometry stabilizer and that of a variable-angle bent element.

In this example, it may be considered that to trigger control of the variable-angle bent element, it is necessary for the flowrate to rise from Qmin to a flowrate higher than a given flowrate Qactcou and within a time interval less than DT. Just as for triggering control of the variable-geometry stabilizer, it is necessary for the flowrate of the drilling fluid to rise from a flowrate Qmin1 to a flowrate higher than a given flowrate Qactstab within a time interval less than DT1.

In this figure, to simplify the example, it is assumed that:

Qmin=Qmin1, that DT=DT1, and that Qactstab is greater than Qactcou.

Under these conditions, it may be seen that the flowrate sequence corresponding to curve 62, which has exceeded flowrate Qactcou within a time interval less than DT without exceeding flowrate Qactstab, triggers actuation of the variable-angle bent element, while curve 63, which exceeded Qactstab within a time interval less than DT, triggers actuation of the variable-geometry stabilizer and the variable-angle bent element.

Such a procedure may be implemented by establishing, from one end to the other, an assembly exactly the same as that of FIGS. 3A and 3B and another derived from FIGS. 3A and 3B, but which controls a variable-geometry stabilizer.

The procedure described in FIG. 5 may be used as indicated below.

Actuation of the stabilizer is triggered as many times as is necessary to place it in the desired position, then actuation of the bent element is triggered without triggering the stabilizer as many times as desired to place it in the desired position.

Thus, after these operations, the variable-geometry stabilizer and the variable-angle bent element are in the desired configurations.

Figure 4:
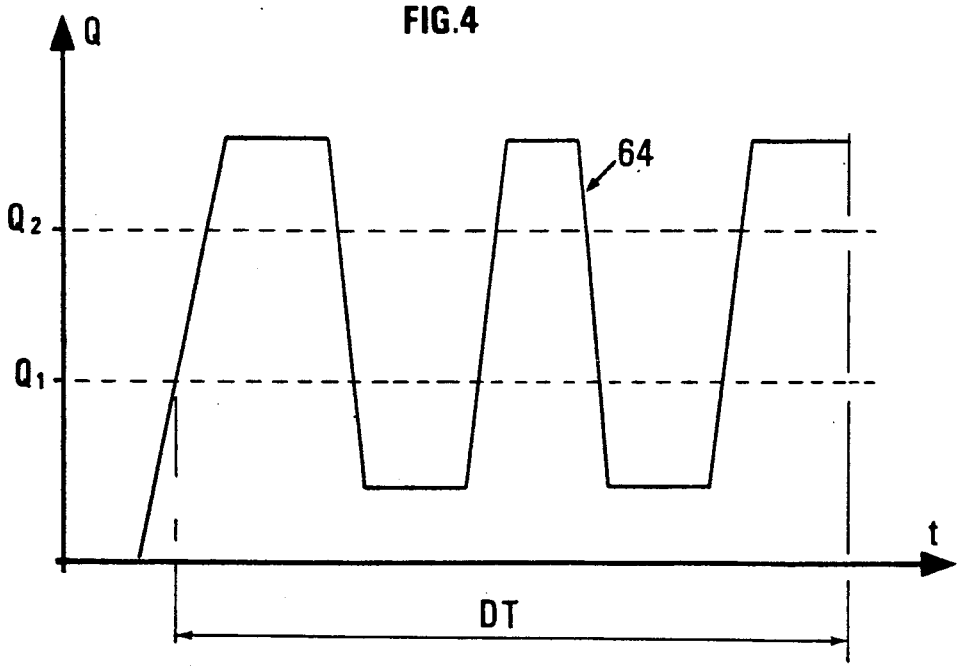
FIGS. 4 and 5 represent other types of sequences, and FIG. 6 schematically illustrates a device according to the invention.

FIG. 4 shows a triggering sequence which avoids the use of a specific flowrate sensor.

The flowrate sequence corresponds to a series of occasions on which two thresholds $Q_1$ and $Q_2$ are exceeded, which must occur within a time interval less than DT.

For example, in a time interval of 10 min, one must start from $Q=0$, in fact Q less than $Q_1$, then Q must be greater than $Q_2$, then Q less than $Q_1$, then Q greater than $Q_2$, then Q less than $Q_1$, and finally Q greater than $Q_2$, corresponding to curve 64.

It may be that $Q_1=Q_2$.

In the above examples, it is sometimes necessary for the sequences to include a variation in one of these magnitudes: drilling fluid flowrate, rotational speed of at least part of the drill string, or weight on the tool for a maximum period of time, or a minimum time interval may be imposed and these two time limits combined.

Thus, it is appropriate for the desired variation to occur within a predetermined time window.

For example, if the flowrate is considered the magnitude, it may be agreed that the sequence detected will trigger a control instruction only if the variation in flowrates from Qmin to Qact takes place within a time interval greater than 5 minutes but less than 10 minutes.

We claim:

1. A method of controlling drill string equipment extending within a bore hole from a first location on the surface of the earth to a second location beneath the surface of the earth, said method comprising:

issuing from the first location a control sequence to cause a first predetermined action in a first portion of the drill string;

detecting in a second portion of the drill string a condition resulting from the first predetermined action;

comparing the detected condition with a predetermined condition; and when the detected condition meets or exceeds the predetermined condition, causing a second predetermined action in a third portion of the drill string.

2. A method according to claim 1, wherein the detected condition includes changes as a function of time in at least one of the following parameters: start of flow of drilling fluid, rotational speed of at least part of the drill string, and weight on a tool included as a part of the drill string.

3. A method according to claim 2, wherein the detected condition includes at least two of said parameters.

4. A method according to one of claims 2 or 3 wherein the detected condition includes said changes in said parameters occurring within a given maximum time interval.

5. A method according to claim 4 wherein the detected condition further includes said changes occurring after a given minimum time interval.

6. A method according to claim 1, wherein the detected condition includes at least one of the flowrate level of drilling fluid and the flowrate rising from a first flowrate level to a second flowrate level within a given time interval.

7. A device for controlling drill string equipment extending within a well bore from a first location on the surface of the earth to a second location beneath the surface of the earth, said device comprising:

first means at the first location for issuing a control sequence to cause a first predetermined action in a first portion of the drill string;

second means for detecting in a second portion of the drill string a condition resulting from the first predetermined action;

third means for comparing the detected condition with a predetermined condition; and means responsive to the detected condition meeting or exceeding the predetermined condition for causing a second predetermined action in a third portion of the drill string.

8. A device according to claim 7, wherein said first means comprises a drilling fluid pump, said second means comprises a flowmeter and a flowrate measurement processing module, and said third means comprises at least one solenoid valve.

9. A device according to claim 8, wherein said solenoid valve is adapted to place in communication, when energized, a reservoir of pressurized oil and a chamber whose change in volume is adapted to actuate the drill string equipment.

10. A device according to claim 9, wherein said third means further comprises a check valve adapted to allow oil in the chamber to discharge into the reservoir when the oil pressure in the reservoir is less than the oil pressure in the chamber.

11. A device according to one of claims 7, 8, 9 or 10, wherein said equipment comprises a variable-angle bent element.

12. A device according to one of claims 7, 8, 9 or 10, wherein said equipment comprises a variable-geometry stabilizer.

* * * * *